US006313722B1

(12) United States Patent
Tsuzuki et al.

(10) Patent No.: US 6,313,722 B1
(45) Date of Patent: Nov. 6, 2001

(54) FILTER HAVING RESONANT FREQUENCY ADJUSTED WITH DIELECTRIC LAYER

(75) Inventors: Genichi Tsuzuki, Nishikamo-gun; Masanobu Suzuki, Toki, both of (JP)

(73) Assignee: Advanced Mobile Telecommunication Technology Inc., Nisshin (JP)

( * ) Notice: Subject to any disclaimer, the term of this patent is extended or adjusted under 35 U.S.C. 154(b) by 0 days.

(21) Appl. No.: 09/349,452

(22) Filed: Jul. 8, 1999

(30) Foreign Application Priority Data

Feb. 24, 1999 (JP) ..... 11-046878

(51) Int. Cl.[7] ..... H01P 7/10; H01P 1/20
(52) U.S. Cl. ..... 333/219.1; 333/204; 333/205
(58) Field of Search ..... 333/205, 235, 333/204, 219.1, 231

(56) References Cited

U.S. PATENT DOCUMENTS

| | | | | |
|---|---|---|---|---|
| 3,938,064 | * | 2/1976 | O'Bryan, Jr. et al. | 333/204 |
| 3,963,982 | | 6/1976 | Roberts | 324/727 |
| 4,142,164 | * | 2/1979 | Nishikawa et al. | 333/219.1 |
| 4,623,835 | | 11/1986 | Mehdizadeh et al. | 324/636 |
| 4,629,977 | | 12/1986 | English | 324/76.51 |
| 4,735,906 | | 4/1988 | Bastiaans | 436/527 |
| 5,227,730 | | 7/1993 | King et al. | 324/632 |
| 5,334,941 | | 8/1994 | King | 324/637 |

OTHER PUBLICATIONS

Gerhard Sollner et al., "High–Power YBCO Microwave Filters and Their Nonlinearities", 5[th] International Superconductive Electronics Conference (ISEC '95), Sep. 18–21, 1995, Nagoya, Japan.
Co–pending Application No. 09/349,450.
Gerhard Sollner et al, "High–Power YBCO Microwave Filters and Their Nonlinearities", 5[th] *International Superconductive Electronics Conference* (*ISEC '95*), Sep. 18–21, 1995, Nagoya, Japan, pp. 517–520.

* cited by examiner

*Primary Examiner*—Robert Pascal
*Assistant Examiner*—Kimberly E Glenn
(74) *Attorney, Agent, or Firm*—Nixon & Vanderhye P.C.

(57) ABSTRACT

Plural resonators formed on a dielectric substrate constitute a filter. The resonant frequency of each resonator is adjusted to a target frequency by accumulating dielectric material on the resonator. The degree of such adjustment is substantially proportional to the amount of the dielectric material. The resonators are originally designed to have a resonant frequency that is a little higher than the target frequency. The resonant frequency of each resonator deviates from the designed target because of various factors in manufacturing processes. Each resonant frequency is measured, its deviation from the target is calculated, and the amount of the dielectric material required to eliminate such deviation is determined before the adjustment process. Accordingly, the adjustment is easily performed without measuring the resonant frequency during the adjustment process.

16 Claims, 5 Drawing Sheets

FIG. 3

| RESONATOR NO. | 11 | 12 | 13 | 14 | 15 | 16 | 17 | 18 |
|---|---|---|---|---|---|---|---|---|
| RESONANT FREQUENCY (GHz) | 2.0075 | 2 | 2.015 | 2.01 | 2.03 | 2.0075 | 2.015 | 2.005 |
| FREQUENCY DEVIATION (GHz) | 0.0075 | 0 | 0.015 | 0.01 | 0.03 | 0.0075 | 0.015 | 0.005 |
| AREA TO BE COVERED WITH DIELECTRIC LAYER | 1/4 | 0 | 1/2 | 1/3 | 1 | 1/4 | 1/2 | 1/6 |

FILTER HAVING RESONANT FREQUENCY ADJUSTED WITH DIELECTRIC LAYER

CROSS-REFERENCE TO RELATED APPLICATION

This application is based upon and claims benefit of priority of Japanese Patent Application No. Hei-11-046878 filed on Feb. 24, 1999, the content of which is incorporated herein by reference.

BACKGROUND OF THE INVENTION

1. Field of the Invention

The present invention relates to a filter having resonators, the resonant frequency of which is adjusted with a dielectric layer formed on the resonators, and to a method of adjusting the resonant frequency of such resonators.

2. Description of Related Art

A filter characteristic such as resonant frequency has to be adjusted after its manufacturing process is completed, because the characteristic usually deviates from its target due to various deviation factors such as dielectric constant of a substrate, thickness of layers, accuracy of a mask, manufacturing process conditions and the like. Such characteristic adjustment, or tuning is especially necessary for narrow band and low ripple filters.

Conventionally, a resonant frequency of a filter has been tuned by adjusting an effective dielectric constant of a resonator with a screw that carries a dielectric member at its tip, or by trimming a resonator pattern with a laser beam. In both methods, it is necessary to carry out the adjustment or tuning while the filter characteristic is being measured. Such adjustment under measurement is not easy, especially when a filter is constituted by a large number of resonators.

SUMMARY OF THE INVENTION

The present invention has been made in view of the above-mentioned problem, and an object of the present invention is to provide a filter, the resonant frequency of which is easily adjusted, and more particularly, to provide a filter having plural resonators, in which the resonant frequency of each resonator is easily adjusted independently from one another. Another object of the present invention is to provide an improved method of adjusting the resonant frequency of the resonators, which can be carried out without watching a measuring instrument.

A filter is composed of a dielectric substrate, plural resonators formed on one surface of the substrate and a ground plane formed on the other surface of the substrate. A dielectric layer is formed on each resonator to adjust or tune the resonant frequency of the resonator. The resonators and the ground plane may be made of a superconductive material, and each resonator is ring-shaped with one portion opened with a narrow gap. The resonant frequency of each resonator is equalized to a target resonant frequency by accumulating a proper amount of a dielectric material as a layer formed on the resonator.

The resonators are designed so that their resonant frequencies are a little higher than a target resonant frequency, because the resonant frequency is adjusted by the dielectric layer only in the direction to decrease the resonant frequency. After the plural resonators are formed on the substrate, the resonant frequency of each resonator is measured and compared with the target frequency, thereby determining frequency deviation of each resonator. The larger the deviation is, the higher amount of the dielectric material is accumulated on the resonator. Thus, the resonant frequencies of all the resonators are adjusted to the target frequency.

The dielectric layer may be formed in a photolithography process. Preferably, the dielectric layer having the same thickness is formed on each resonator, and the amount of the dielectric material is controlled by changing the areal size of the dielectric layer covering each resonator. The resonant frequency of each resonator is adjusted independently from one another by changing the covering area of the dielectric layer. It is preferable to pattern all the dielectric layers, each covering each resonator with a respective areal size, at the same time using a single mask in the photolithography process. Preferably, one resonator showing the highest frequency deviation is fully covered with the dielectric layer while other resonators are partially covered. Alternatively, the amount of the dielectric layer may be controlled by changing its thickness while keeping the covering area constant.

Since the resonant frequency deviation from the target frequency of each resonator is measured, and the amount of the dielectric material required to eliminate such deviation is determined before the adjustment process, it is not necessary to measure the resonant frequency during the adjustment process. Thus, the adjustment or tuning process is simplified, especially when a large number of resonators are used in a filter.

Other objects and features of the present invention will become more readily apparent from a better understanding of the preferred embodiment described below with reference to the following drawings.

BRIEF DESCRIPTION OF THE DRAWINGS

FIG. 3 is a table showing resonant frequencies and frequency deviations of each resonator;

DETAILED DESCRIPTION OF THE PREFERRED EMBODIMENT

Figure 1:
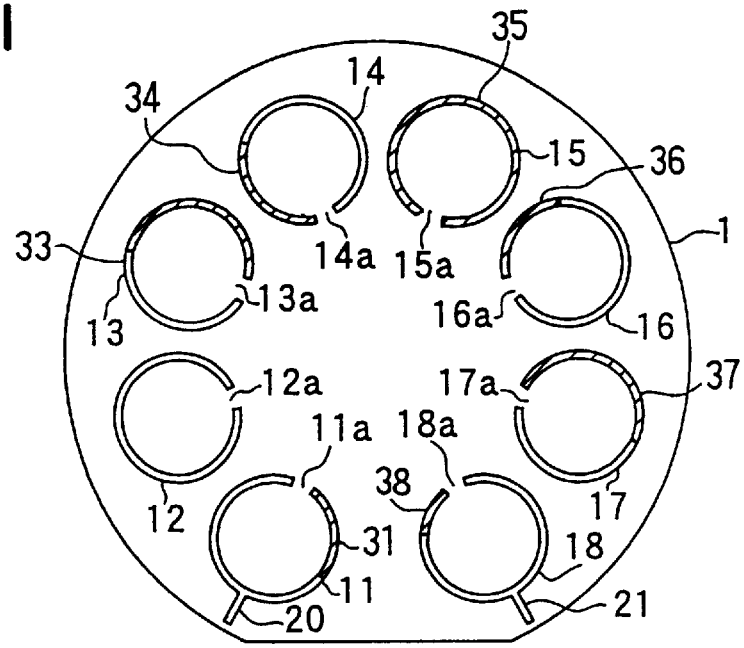
FIG. 1 is a plan view showing a filter having plural resonators, the resonant frequency of each of which is adjusted with a dielectric layer.
Figure 2:
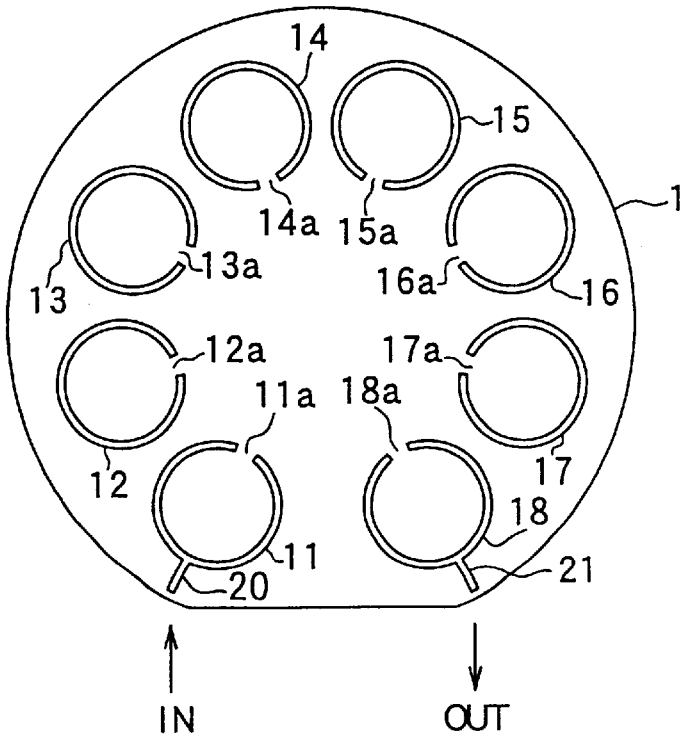
FIG. 2 is a plan view showing a filter having plural resonators, the resonant frequency of which is not adjusted.

A preferred embodiment of the present invention will be described with reference to the drawings. FIG. 1 shows a filter after resonant frequency adjustment is completed, while FIG. 2 shows the filter before the adjustment. First, referring to FIG. 2, a filter is composed of a dielectric substrate 1, plural resonators 11–18 formed on the dielectric substrate 1 and a ground plane (not shown) formed on the rear surface of the substrate 1. The filter is a distributed-constant-type filter and has a microstrip line structure. The plural resonators 11–18 are positioned along a circle having a certain radius from the center of the round substrate 1. A loop length of each resonator is designed to be one half of a wave length (λ), and one portion of the loop is open toward the center of the substrate 1. The open portion of each loop forms respective gaps 11*a*–18*a*. A terminal 20 for an input signal is tapped from the resonator 11, and a terminal 21 for an output signal is tapped from the resonator 18. The resonators 11–18 and the ground plane are made of a superconductive material, and the substrate 1 is made of a dielectric material. In this particular embodiment, each resonator 11–18 is designed so that its resonant frequency becomes 2 GHz. In other words, the target resonant frequency is 2 GHz.

To adjust any deviation from the target resonant frequency, the resonant frequency of each resonator is first measured in a method described later, and then dielectric layers 31, 33–38 are formed on the resonators to be adjusted as shown in FIG. 1. In this particular example shown in FIG. 1, the resonator 12 need not be adjusted or tuned, while all other resonators have to be adjusted. The dielectric layers 31, 33–38 are made of a dielectric material such as CeO, MgO, $SiO_2$ or the like.

Figure 6:
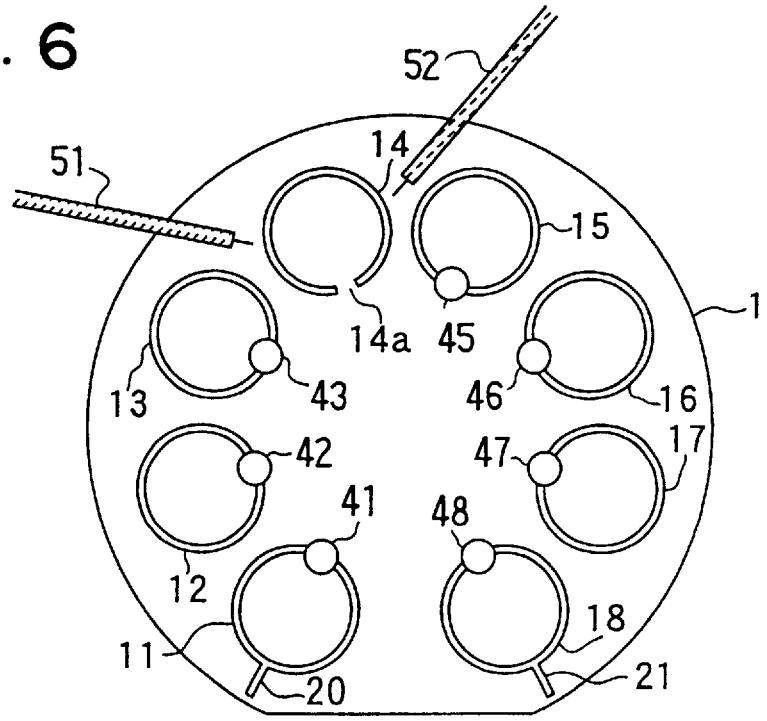
FIG. 6 is a plan view showing a method of measuring a resonant frequency of a selected resonator, other resonators being short-circuited by conductive members.
Figure 5A:
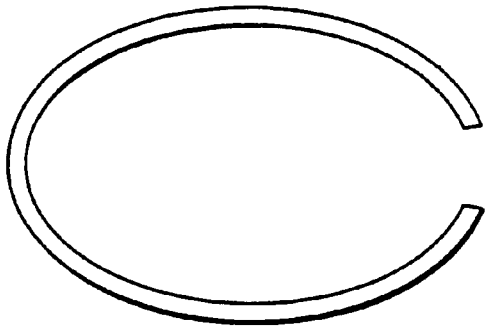
FIGS. 5A–5D are plan views showing various patterns of the resonator.
Figure 5B:
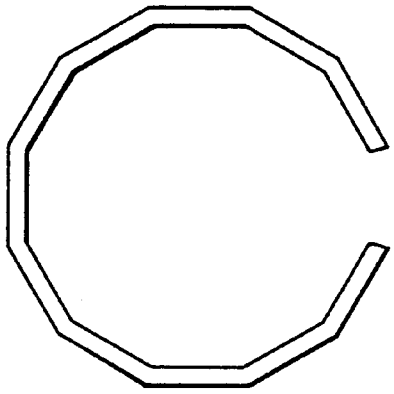
Figure 5C:
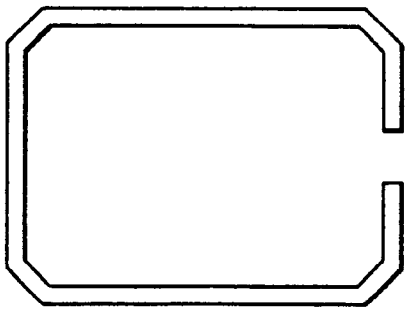
Figure 5D:
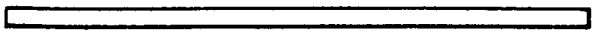
Figure 7:
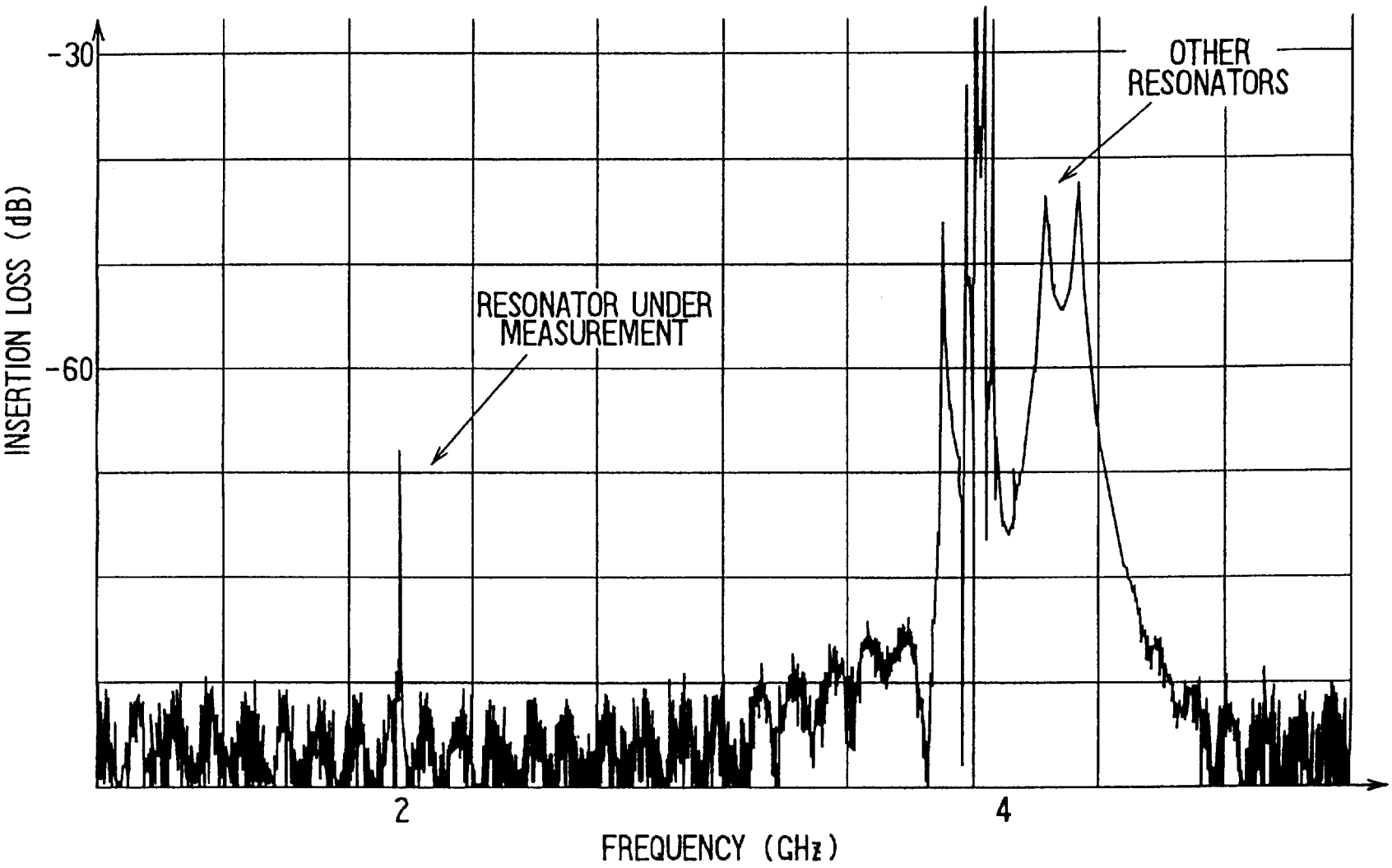
FIG. 7 is a graph showing frequencies at which a peak insertion loss appears in a resonator under measurement and other resonators, respectively.

The resonant frequency of each resonator 11–18 is measured as shown in FIG. 6. FIG. 6 shows an exemplary situation where one resonator 14 is selected as a resonator to be measured. In order to avoid interference due to electromagnetic coupling between the selected resonator 14 and non-selected resonators, all the gaps of the non-selected resonators are short-circuited with conductive members 41–43, 45–48. The conductive material may be silver paste, a conductive tape or the like, which is easily removable. Thus, the resonant frequency of the resonator 14 can be precisely measured without interference with other resonators. An input probe 51 and an output probe 52 are placed as shown in FIG. 6, and the resonant frequency of the resonator 14 is measured. When the non-selected resonators are short-circuited, their resonant frequencies shift to a high side, becoming about double, that is, from about 2 GHz to about 4 GHz. This resonant frequency shift is shown in FIG. 7. The resonant frequency (the frequency at which insertion loss shows a peak) of the resonator 14 that is selected to be measured is about 2 GHz, while the resonant frequencies of non-selected resonators that are short-circuited are around 4 GHz. In this manner, the resonant frequency of the selected resonator 14 is precisely measured. Non-selected resonators 11–13, 15–18 are measured in the same manner as the resonator 14 by selecting one by one and short-circuiting other resonators.

The results of resonant frequency measurement are shown in FIG. 3. Resonator numbers 11–18 are shown in the first row, the respective resonant frequencies in the second row in terms of GHz, the frequency deviations from the target frequency (2 GHz) in the third row, and the area to be covered with the dielectric layers to eliminate the deviations in the fourth row. As seen in FIG. 3, all of the resonant frequencies are equal to or a little higher than the target frequency 2 GHz, because the resonators are intentionally so designed. The reason for this is that the resonant frequency can be adjusted only to the lower side, not to the higher side, by accumulating the dielectric member on the resonator. The frequency deviations of the resonators 11–18 are 0.0075, 0, 0.015, 0.01, 0.03, 0.0075, 0.015 and 0.005 GHz, respectively. The No. 12 resonator has the target resonant frequency, requiring no adjustment. The No. 15 resonator shows the highest deviation from the target frequency, requiring a highest degree of adjustment. The deviations of other resonators are all inbetween those of No. 12 and No. 15.

In other experiments, it has been proved that the resonant frequency decreases by 0.06 GHz, if a whole surface of the resonator is covered by the dielectric layer having a thickness of 1 μm. Also, the resonant frequency decrease is substantially proportional to the amount of the dielectric material covering the resonator surface. Accordingly, if the whole surface of No. 15 resonator is covered with 0.5 μm-thick dielectric layer, its resonant frequency decreases by 0.03 GHz to the target frequency 2 GHz. In the same manner, the area to be covered with the 0.5 μm-thick dielectric layer is determined for other resonators, as shown in the fourth row of the table in FIG. 3. FIG. 1 shows each resonator covered with the dielectric layer having the respective areas shown in FIG. 3 to eliminate the frequency deviation. Thus, the resonant frequencies of all the resonators 11–18 are adjusted to the target frequency 2 GHz, all the deviations being eliminated.

Figure 4A:
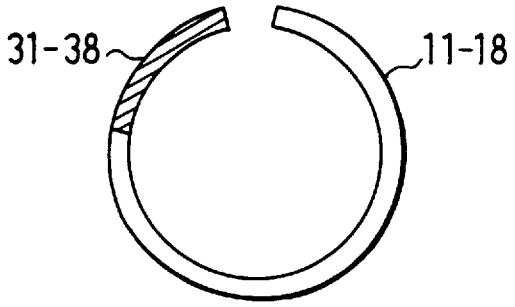
FIG. 4A is a plan view showing a resonator on which a dielectric layer is formed near a pattern gap.
Figure 4B:
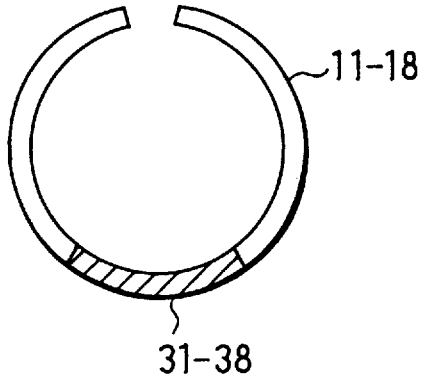
FIG. 4B is a plan view showing a resonator on which a dielectric layer is formed at the center of a pattern.

The dielectric material 31, 33–38 may be accumulated or formed on the resonators 11, 13–18 by using photolithography technology that is widely used in semiconductor manufacturing processes. For example, the dielectric material may be accumulated on the resonator to partially cover its surface by a liftoff process. The mask to be used in the photolithography precess may be the one to individually cover each resonator, or the one to cover all the resonators at the same time. FIGS. 4A and 4B show positions of the dielectric layer partially covering the resonator surface. The dielectric layer 31–38 may be positioned at the open end portion of the resonator 11–18 as shown in FIG. 4A, and it may be positioned at the center portion as shown in FIG. 4B. The degree of resonant frequency decrease is higher when the dielectric layer is positioned at the open end portion than when it is positioned at the center portion. Accordingly, it is preferable to place the dielectric layer at the open end portion if a large amount of frequency shift is required, while it is preferable to place it at the center portion if fine tuning is required.

Since the resonant frequency of each resonator is adjusted to the target frequency by accumulating individually different amount of the dielectric material, no damage is given to the resonator material such as a superconductive material in the adjusting process. Also, even if a large number of resonators are used in a filter, the adjustment process can be easily carried out. In addition, the frequency adjustment or tuning can be performed with high precision through the photolithography process.

The shape of the resonator is not limited to the ring shape shown in FIGS. 1 and 2, but it may be variously changed. FIGS. 5A–5D show some of the variations of the resonator shape. Though the dielectric layer is formed on the resonator surface with a uniform thickness, and the covering area is altered depending on the frequency deviation to be adjusted in the foregoing embodiment, the dielectric layer thickness may be altered while keeping the covering area constant. Though the filter using a superconductive material is shown in the foregoing embodiment, the present invention may be applied also to a filter using a usual conductive material.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A filter comprising:

a dielectric substrate;

a plurality of resonators formed on the dielectric substrate, each resonator having its own resonant frequency;

a dielectric layer covering a surface of each resonator, wherein:

the resonant frequency of each resonator is adjusted to a predetermined resonant frequency that is common to all resonators by controlling an amount of a dielectric material of the dielectric layer formed on each resonator;

the dielectric layer is formed on each resonator with a same thickness; and the amount of the dielectric material of the dielectric layer formed on each resonator is controlled independently from one another by changing an area of the dielectric layer covering each resonator.

2. The filter as in claim 1, wherein:

the dielectric layer is formed on the resonator by a photolithography process.

3. A filter comprising:

a dielectric substrate;

a plurality of resonators formed on one surface of the substrate, the resonators being made of a superconductive material, each resonator having its own resonant frequency;

a ground plane formed on the other surface of the substrate, the ground plane being made of a superconductive material; and a dielectric layer formed on each resonator with a same thickness, wherein:

an areal size of the dielectric layer covering each resonator is controlled independently from one another, so that the resonant frequency of all the resonators is adjusted to a predetermined common target frequency.

4. A method of adjusting a resonant frequency of a filter having a plurality of resonators, the method comprising steps of:

short circuiting each resonator other than a selected one of said plurality of resonators;

measuring a resonant frequency of the selected resonator; and accumulating a dielectric material on the selected resonator in a controlled manner to adjust the measured resonant frequency of the selected resonator to a target frequency.

5. The method as in claim 4, wherein:

each of said plurality of resonators respectively includes open ends and said short circuiting step includes respectively connecting the open ends of each resonator other than a selected one of said resonators.

6. A method of adjusting a resonant frequency of a filter having a plurality of resonators each with respective open ends, the method comprising steps of:

measuring a resonant frequency of each resonator;

determining each frequency deviation from a predetermined target resonant frequency that is common to all the resonators; and accumulating a dielectric material on each resonator at a position closer to said respective open ends as the predetermined frequency deviation increases so that the resonant frequency of all the resonators become equal to the target frequency by eliminating the frequency deviation.

7. A method of adjusting a resonant frequency of a filter having a plurality of resonators, the method comprising the steps of:

measuring a resonant frequency of each resonator;

determining each frequency deviation from a predetermined target resonant frequency that is common to all the resonators; and accumulating a dielectric material on each resonator in a controlled manner so that the resonant frequency of all the resonators become equal to the target frequency by eliminating the frequency deviation;

wherein the dielectric material is accumulated on the resonator using a photolithography process.

8. The method of adjusting a resonant frequency of a filter as in claim 7, wherein:

the dielectric material is accumulated on each resonator as a layer with a same thickness common to all the resonators; and an areal size of the layer covering each resonator is controlled so that the resonant frequency of all the resonators becomes equal to the target frequency.

9. The method of adjusting a resonant frequency of a filter as in claim 8, wherein:

the areal size of the layer covering each resonator is controlled by a single mask common to all the resonators in the photolithography process.

10. The method of adjusting a resonant frequency of a filter as in claim 8, wherein:

a whole area of one resonator that has a highest frequency deviation is covered with the dielectric material.

11. A method of adjusting a resonant frequency of a filter having a plurality of resonators each of which is made of a superconductive material on a dielectric substrate, the method comprising steps of:

protecting a selected resonator of said plurality of resonators from interference of other resonators of said plurality of resonators, the interference being caused by electromagnetic coupling between the selected resonator and the other resonators;

measuring a resonant frequency of the selected resonator while protecting the selected resonator from the interference; and accumulating a dielectric material on the selected resonator to adjust the measured resonant frequency to a target frequency.

12. The method as in claim 11, wherein:

the protecting step includes a step of electrically connecting open ends of each superconductive material of the other resonators so that each of the other resonators has a closed pattern.

13. The method as in claim 11, further comprising a step of:

repeating the protecting step, the measuring step and the accumulating step after changing the selected resonator from a first selected resonator to another selected resonator among said plurality of resonators.

14. The method as in claim 13, wherein:

the dielectric material is accumulated in a same thickness among the resonators and varied in area which is covered by the dielectric material from resonator in correspondence with each measured resonant frequency.

15. The method as in claim 13, wherein:

the dielectric material is accumulated at a position closer to open ends of the superconductive material of each resonator as a deviation of the measured resonant frequency from the target frequency increases.

16. The method of claim 11, wherein:

the protecting step includes short circuiting said other resonators.

* * * * *